United States Patent [19]

Hull

[11] 4,371,188

[45] Feb. 1, 1983

[54] METHOD FOR PROGRAMMED RELEASE IN SKI BINDINGS

[75] Inventor: Maury L. Hull, Davis, Calif.

[73] Assignee: University of California, Berkeley, Calif.

[21] Appl. No.: 162,413

[22] Filed: Jun. 24, 1980

[51] Int. Cl.[3] ..... A63C 9/08

[52] U.S. Cl. ..... 280/613; 73/862.04

[58] Field of Search ..... 280/611, 612, 613, 618, 280/623; 73/862.02, 862.04

[56] References Cited

U.S. PATENT DOCUMENTS

| | | | |
|---|---|---|---|
| 3,246,907 | 4/1966 | Chisholm | 280/11.35 |
| 3,251,607 | 5/1966 | Wren | 280/11.35 |
| 3,318,610 | 5/1967 | Kulick | 280/11.35 |
| 3,340,726 | 9/1967 | Armstrong et al. | 73/862.04 X |
| 3,367,672 | 2/1968 | Tonozzi et al. | 280/11.35 |
| 3,727,932 | 4/1973 | Druss et al. | 280/11.35 K |
| 3,762,735 | 10/1973 | Smolka | 280/11.35 M |
| 3,774,922 | 11/1973 | Smolka et al. | 280/11.35 M |
| 3,776,566 | 12/1973 | Smolka | 280/11.35 M |
| 3,794,339 | 2/1974 | Smolka | 280/11.35 M |
| 3,802,715 | 4/1974 | Turnheim et al. | 280/11.35 M |
| 3,819,199 | 6/1974 | Smolka et al. | 280/11.35 M |
| 3,820,803 | 6/1974 | Frisch et al. | 280/11.35 M |
| 3,826,509 | 6/1974 | Smolka | 280/11.35 M |
| 3,892,980 | 7/1975 | Anderson | 307/116 |
| 3,902,729 | 9/1975 | Druss | 280/11.35 R |
| 3,907,316 | 9/1975 | Marker et al. | 280/11.35 M |
| 3,919,563 | 11/1975 | Lautier et al. | 307/119 |
| 3,940,156 | 2/1976 | Marker | 280/11.35 R |
| 3,947,051 | 3/1976 | Sittmann | 280/11.35 R |
| 3,960,383 | 6/1976 | O'Neil | 280/612 |
| 4,121,854 | 10/1978 | Cornu | 280/612 |
| 4,126,039 | 11/1978 | Smith et al. | 73/862.04 X |
| 4,291,894 | 9/1981 | D'Antonio et al. | 280/623 X |

FOREIGN PATENT DOCUMENTS

| | | |
|---|---|---|
| 2200057 | 9/1972 | Fed. Rep. of Germany . |
| 2133675 | 1/1973 | Fed. Rep. of Germany . |
| 2146453 | 3/1973 | Fed. Rep. of Germany . |
| 2402684 | 4/1974 | Fed. Rep. of Germany . |
| 2309888 | 8/1974 | Fed. Rep. of Germany . |
| 1728618 | 10/1976 | Fed. Rep. of Germany . |
| 2705174 | 8/1977 | Fed. Rep. of Germany . |
| 2721691 | 12/1977 | Fed. Rep. of Germany . |
| 2748309 | 5/1978 | Fed. Rep. of Germany . |

OTHER PUBLICATIONS

Hull, Maury, "Computers in Your Skiing Future", *Engineering Progress,* University of California, Davis, vol. 5, No. 1, pp. 2-3 et seq., Spring, 1979.

Allen, Kevin W. and Don Westwood, "A Computer Controlled Snow Ski Binding Release," *California Engineer,* vol. LVII, No. 3, pp. 28-34, Feb. 1979.

*Primary Examiner*—Robert R. Song
*Assistant Examiner*—Michael Mar
*Attorney, Agent, or Firm*—Fitch, Even, Tabin, Flannery & Welsh

[57] ABSTRACT

A method for achieving programmed release ski bindings include formulation of biomechanical models and associated equations for determining release criteria in order to minimize selected types of lower extremity ski injuries. Analog and digital control circuits are also disclosed for computing the release variables from the biomechanical model equations and comparing the variable values to the release criteria in order to precisely generate a release initiating signal. Loads measured in the ski binding drive the biomechanical model equations. The ski binding assembly has a releasable binding for rigidly securing the ski boot to the ski with a release actuating element for releasing the ski boot from the binding upon occurrence of a release condition as determined by the associated control circuit.

1 Claim, 16 Drawing Figures

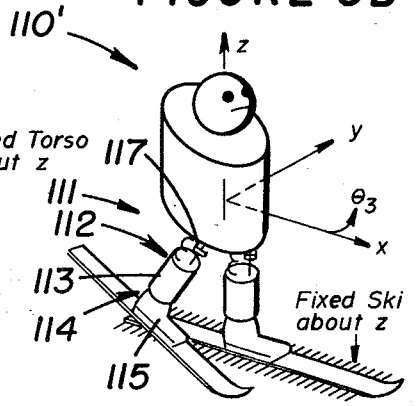
FIGURE 3B
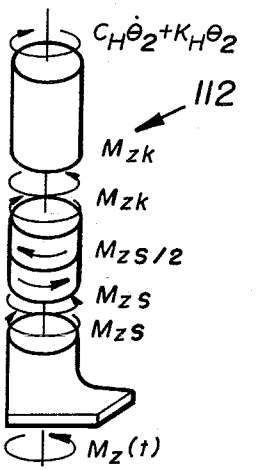
FIGURE 4B
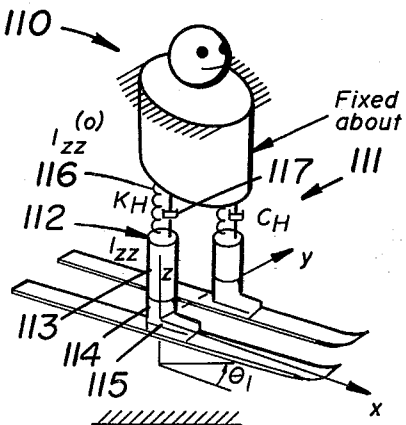
FIGURE 3A
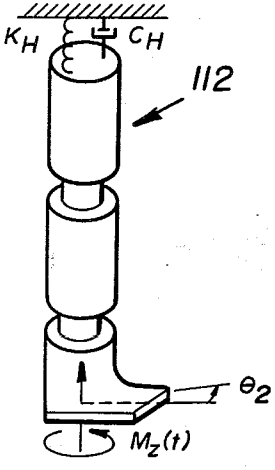
FIGURE 4A
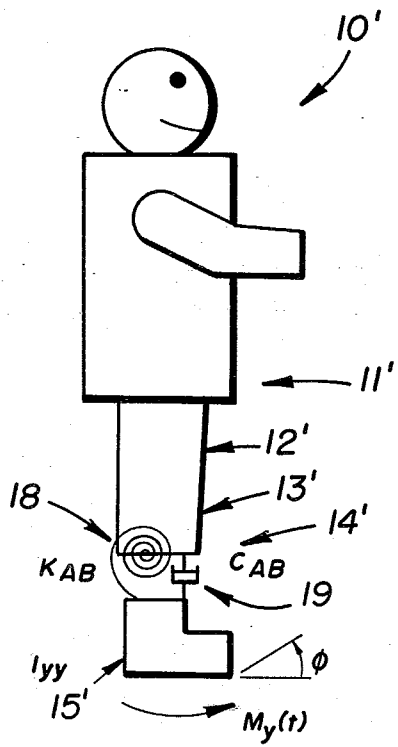
FIGURE IB
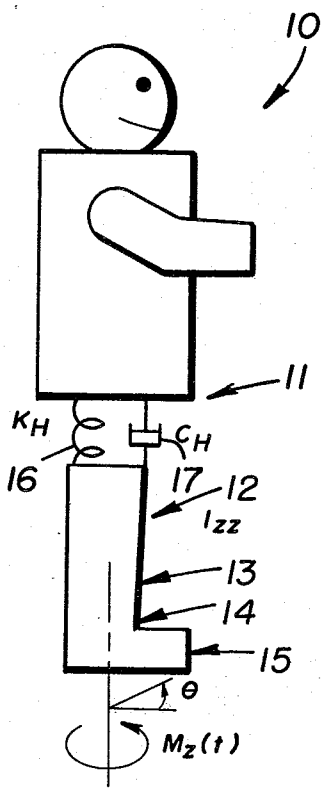
FIGURE IA FIGURE 7
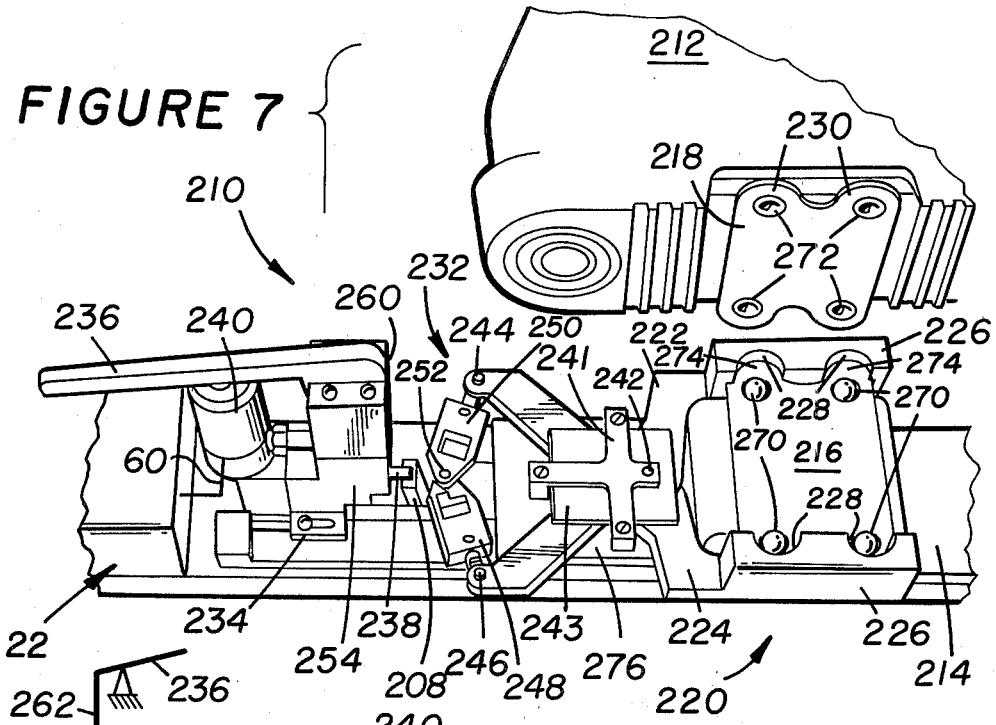
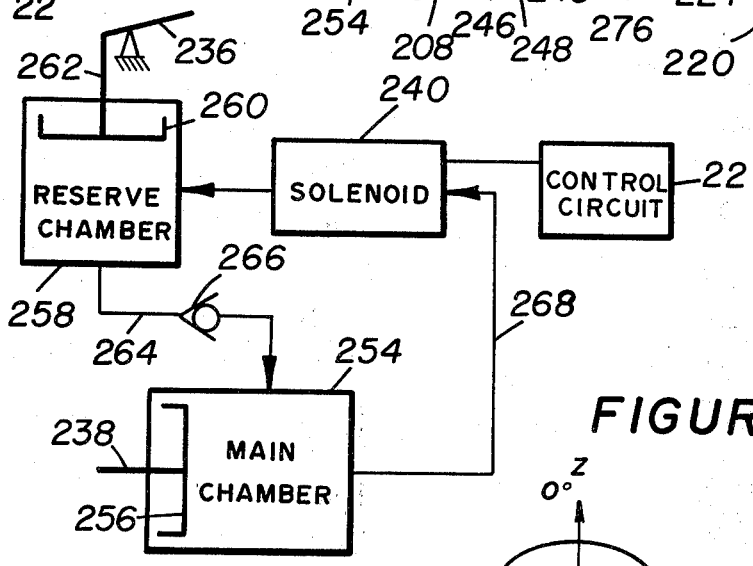
FIGURE 8
FIGURE 9
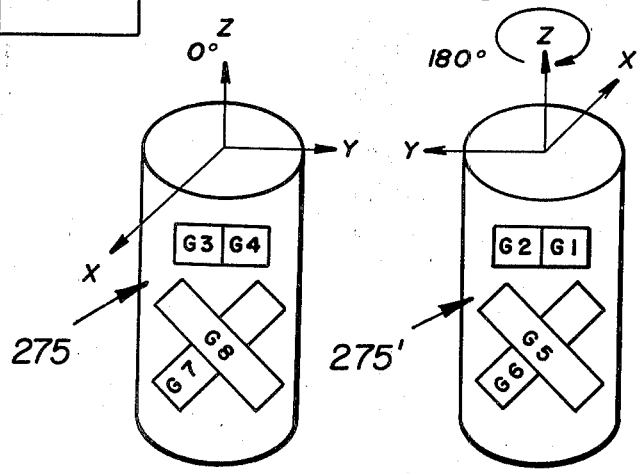

FIGURE 10
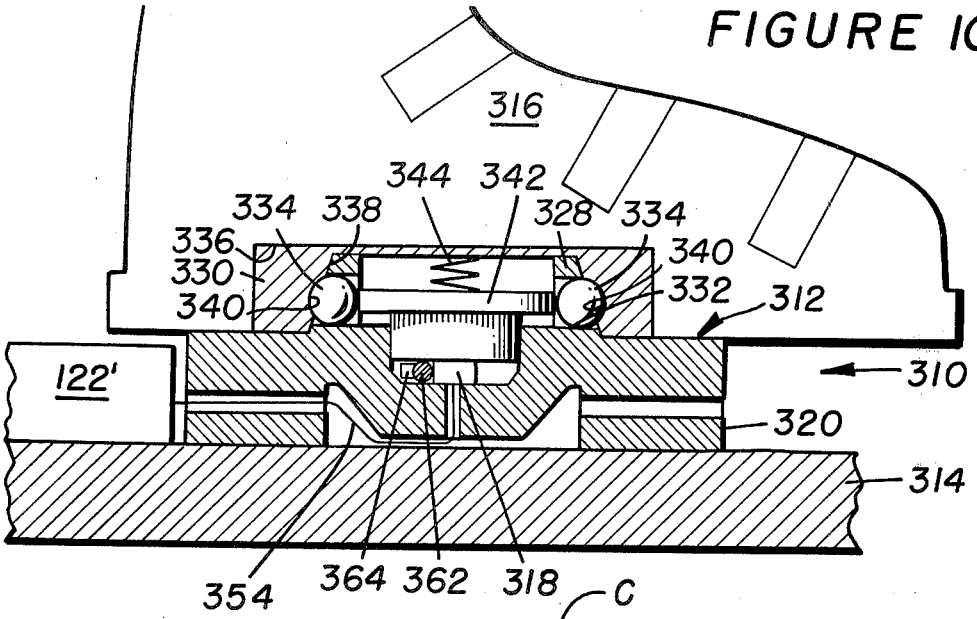
FIGURE 11
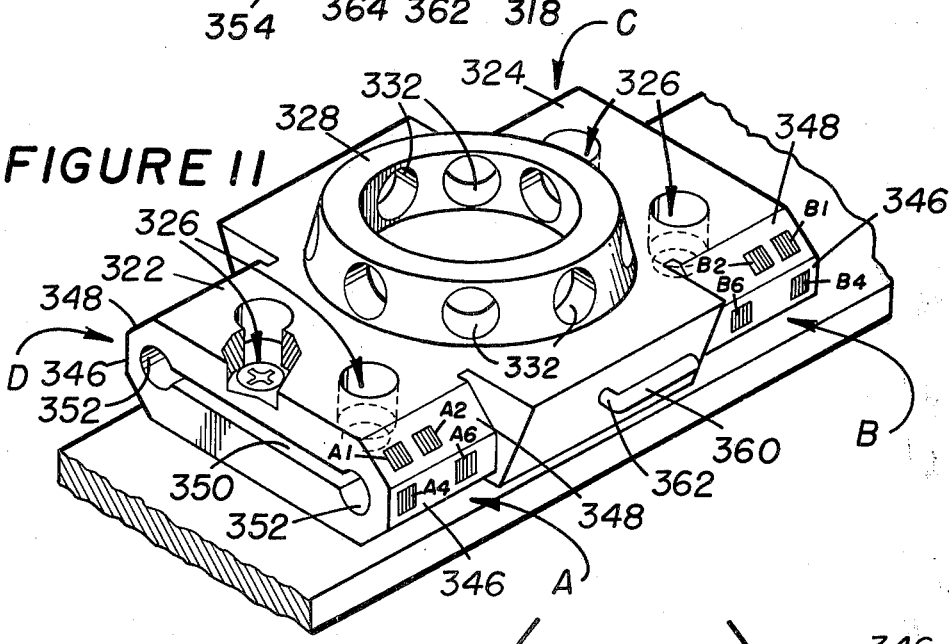
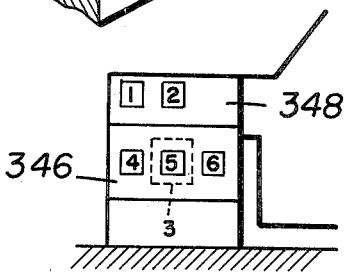
FIGURE 12
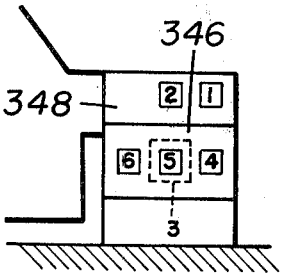
FIGURE 13

METHOD FOR PROGRAMMED RELEASE IN SKI BINDINGS

BACKGROUND OF THE INVENTION

The present invention relates to ski bindings and more particularly to a method and apparatus for initiating release within the bindings in order to prevent or minimize injuries, especially in the lower extremities of the skier.

In the past, a wide variety of ski bindings has been developed and made commercially available in view of the greatly increasing popularity of snow skiing. Along with the increase in popularity and practice of snow skiing, there has been a corresponding increase in injuries, especially in the lower extremities of the skiers. Generally, ski injuries have tended to concentrate in the tibia, in the form of mid-length fracture, as well as in the ankle and knee.

There has been a substantial effort to improve all types of ski equipment for minimizing such injuries including improvements in ski boots and skis themselves as well as in ski bindings. However, much effort directed toward the elimination or prevention of such injuries has concerned the binding since it has been found that release of the skier from the ski is one of the most effective means of protecting the skier during injury-provoking situations such as falls and the like.

Until approximately 1973, commercially available ski bindings were designed and adjusted for mechanically initiating release by limiting the magnitude of loading between the boot and ski. This design approach is generally based upon the theory that deformations, particularly in components of lower extremities of the skier, are directly related to loading magnitude. However, it came to be realized that bindings designed according to this theory did not satisfy the dual requirements of safety and retention. In this connection, safety requires that the binding release the skier in sufficient time to prevent predictable injury. However, because of a failure to accurately predict such injury-provoking situations, bindings adjusted for such safety considerations have often tended to be subject to premature release during skiing, even under conditions appearing unlikely to produce injury. On the other hand, with bindings being adjusted to assure retention under different skiing conditions, there has been found to be a greater tendency for injury.

Accordingly, there has developed another theory for injury prevention during skiing based on the recognition of a dynamic system of the lower skier extremities as a biomechanical system consisting of inertia, stiffness and dissipative elements. It was hypothesized that under loading conditions typical in skiing, such a system is excited dynamically with no direct relationship between applied loading magnitude and deformation. This hypothesis was confirmed by actual tests and measurements indicating that the frequency content of lower extremity loading was sufficient to excite the dynamic model. In order to explain the inability of ski bindings to simultaneously satisfy safety and retention requirements, it was further hypothesized that binding release levels were not sufficiently sensitive to load duration. Accordingly, further experimental studies were conducted for binding release levels under shock loading in order to confirm this hypothesis, whereupon a general conclusion has developed that such a dynamic system theory of lower extremity injury is able to simultaneously satisfy both release and retention requirements.

However, it has been found that ski bindings presently available do not take advantage of this theory or otherwise fail to include suitable techniques or apparatus for initiating release within a binding in order to realize the potential advantages of such a dynamic system.

SUMMARY OF THE INVENTION

It is therefore an object of the present invention to provide a method for initiating release within ski bindings based on the concept of such a dynamic system for the lower extremities of a skier. In general, it is possible to base decisions for initiating release in such a binding on either direct measurement of deformation in lower extremity components of the skier or to calculate such deformations from measurements of other physical variables such as loading, velocity or acceleration. The second possibility has been considered more practical within the present invention and, accordingly, the method of the present invention for initiating release is based upon the measurement of loading between the ski boot and ski.

More particularly, it is an object of the present invention to provide a method for initiating release wherein deformation in lower extremity components of the skier are calculated using a suitable biomechanical model including associated equations for predicting proximity of injury in one or more components of the skier's lower extremity under one or more types of skiing conditions.

Additional objects and advantages of the invention are made apparent in the following description having reference to the accompanying drawings.

BRIEF DESCRIPTION OF THE DRAWINGS

FIGS. 1A and 1B represent different modes of release considered in connection with a single biomechanical model employed for formulation of equations to be used in a method and apparatus for initiating release in a ski binding according to the present invention.

FIGS. 3A and 3B are similarly different representations for another biomechanical model similarly employed for formulation of equations to initiate release in a ski binding according to the present invention.

FIGS. 4A and 4B are further representations of a dynamic system developed within the biomechanical models of FIGS. 3A and 3B.

FIG. 7 is a representation of a ski binding constructed in accordance with the present invention.

FIG. 8 is a schematic representation of a hydraulic unit for actuating and releasing engagement in a ski binding such as that of FIG. 7.

FIG. 9 is a multiple representation of reverse surfaces of a single structural dynamometer or strain gage element.

FIG. 10 is a representation, with parts in section, of another embodiment of a ski binding constructed according to the present invention.

FIG. 11 is similarly a representation of a combined dynamometer/releasable binding element within the ski binding of FIG. 10.

FIGS. 12 and 13 are both representations of the arrangement of strain gages on different portions of the dynamometer of FIGS. 10 and 11.

DESCRIPTION OF THE PREFERRED EMBODIMENTS

Figure 2:
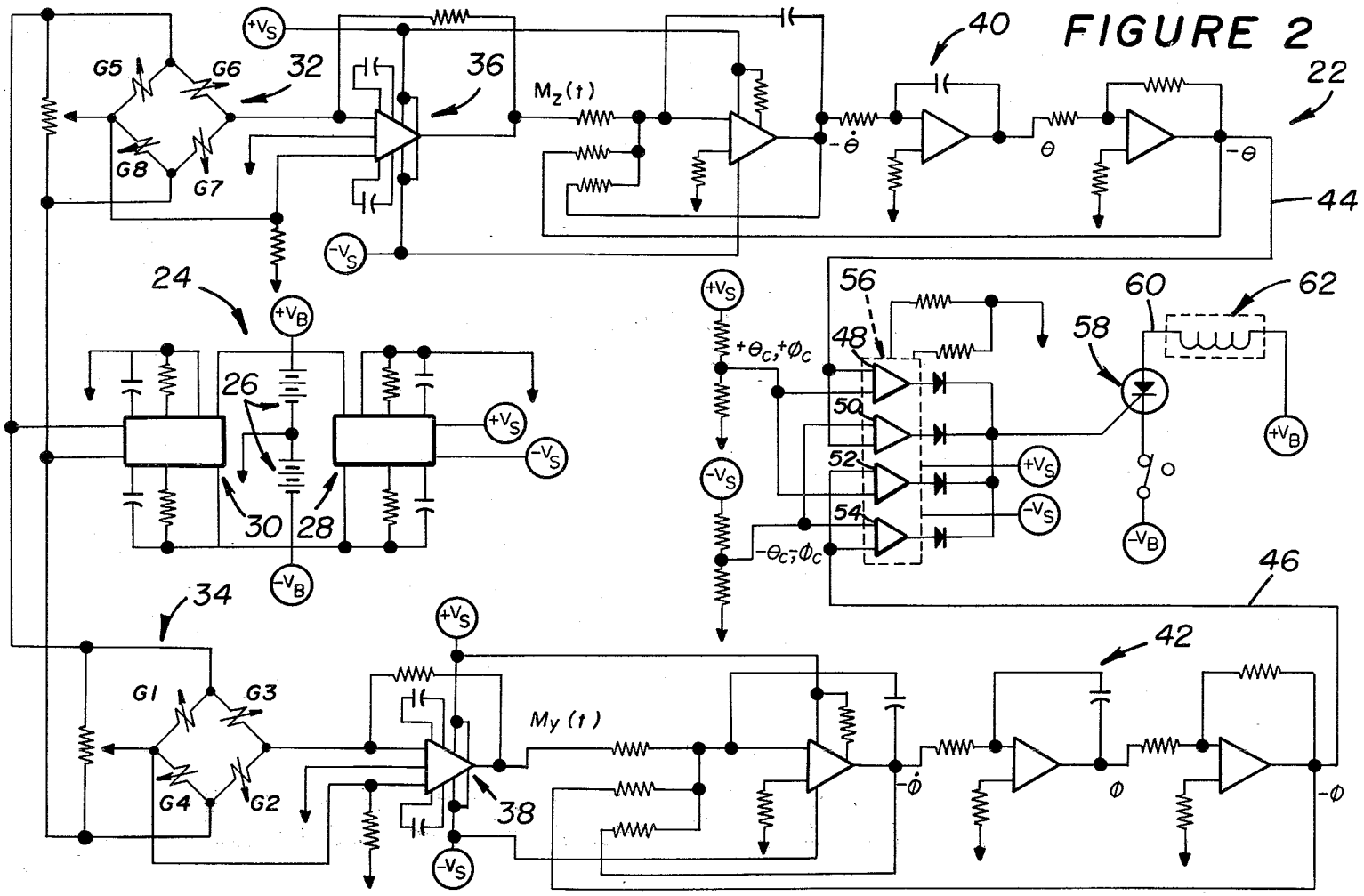
FIG. 2 is a schematic representation of a control circuit adapted for response to measured stresses in a ski binding and for preprogramming by data and equations from a biomechanical model such as that of FIGS. 1A and 1B in order to initiate release within a ski binding.

Within the following description, the method and apparatus for initiating release in a ski binding according to the present invention is defined by description of various concepts and components illustrated by the respective drawings. The description is organized in the following order:

1. FIRST BIOMECHANICAL MODEL.
2. FIRST ANALOG CONTROL CIRCUIT.
3. SECOND BIOMECHANICAL MODEL.
4. SECOND ANALOG CONTROL CIRCUIT.
5. DIGITAL CONTROL CIRCUIT.
6. FIRST SKI BINDING EMBODIMENT.
7. SECOND SKI BINDING EMBODIMENT.

1. FIRST BIOMECHANICAL MODEL

One aspect of the present invention relates to the use of computer means for regulating release of a ski binding according to equations formulated by use of a biomechanical model for simulating deformations particularly in the lower extremities of a skier. In this connection, the invention relates to such a dynamic system or biomechanical model which is used to formulate equations for establishing a release criterion to minimize or prevent lower extremity injury of one or more types. For example, both of the specific biomechanical models described in detail below in connection with the present invention specifically contemplate the prevention of injury in the tibia, such injury occurring most likely as a break generally at midlength.

It will be apparent from the following description that a variation of the biomechanical model could also be employed for establishing release criteria in order to minimize or prevent injury in other portions of the skier's leg. In this regard, two other locations which are particularly susceptible to injury are the ankle and the knee and it will be obvious that similar equations could be formulated from a similar dynamic system or biomechanical model in order to assess injury proximity. With equations available for injuries in various portions of the skier's leg, including for example the knee, tibia and ankle, any combination of those equations could be applied to a computer in order to initiate binding release in the event that injurious conditions are realized.

In the first biomechanical model contemplated by the present invention, emphasis is placed upon preventing breakage in the tibia as noted above and accordingly, both the ankle and knee are assumed to be rigid at least in comparison with the hip. The hip is assumed to be formed by combined factors of yielding stiffness labeled for use in associated equations as $K_H$, the other factorial components of the model being set forth below in connection with the equation derived from this model. The hip in the biomechanical model is represented as a spring and a damping factor shown as a capacitive element labeled $C_H$.

In any event, the first biomechanical model represents the leg of a skier as a single degree-of-freedom, second order linear oscillator while assuming that damping, inertia and stiffness factors for the leg remain constant. With inertia and damping contributions being assumed negligible, loading in the leg of the first biomechanical model is generally determined only by stiffness ($K_H$) times displacement ($\theta$). However, with stiffness also being assumed constant in this model, it then becomes necessary to solve resulting equations only for displacement data which may be accomplished in a controller circuit comprising analog or digital computer as described in greater detail below.

Mathematical treatment of the first biomechanical model in order to formulate an equation or equations for application to the controller circuit or computer in order to define a latent response of the model is described immediately below. Before commencing with development of the equations, it is further noted that the first biomechanical model includes the additional assumptions that the binding for securing the skier's boot to the ski is preferably centered along the axis of the skier's leg with the binding forming a rigid connection between the boot and ski. Further, it has been found from data obtained by study of the biomechanical model that the emphasis on the midpoint of the tibia as the most probable location for breakage is not entirely accurate but is believed valid for the purposes of equations set forth below.

The first biomechanical model referred to above and described in detail below is pictorially represented in FIG. 1A which relates to medial-lateral rotation of the lower extremities of the skier about a vertical axis (see the Z axis of FIG. 3A) for establishing a release criterion serving to initiate release of the binding and FIG. 1B which relates to flexion about a horizontal axis perpendicular to the ski (see the Y axis of FIG. 3A) for establishing another release criterion for initiating release in the binding. The medial-lateral rotation of the first biomechanical model as illustrated at 10 in FIG. 1A is based on the assumption set forth above, with a flexible hip joint 11 and rigid knee joint 12, tibia 13 and ankle joint of the skier between the tibia and rigid ankle joint 14 adjacent the boot 15, the hip 11 being formed by yielding stiffness components represented by a spring 16 indicated as $K_H$ in the equations and a viscous damping factor represented by a capacitive element 17 and indicated as $C_H$ in the equations. Similarly, the flexion mode of the first biomechanical model as illustrated at 10' in FIG. 1B is based on similar assumptions, a similar spring 18 and capacitive element 19 form the ankle joint 14', the hip joint 11' being rigid. The other factors are considered in both of the modes of the first biomechanical model in FIGS. 1A and 1B and are set forth in the following table of nomenclature for the first biomechanical model.

Nomenclature for First Biomechanical Model $I_{zz}^{(1)}$ Thigh moment of inertia about the tibia axis
$I_{zz}^{(2)}$ Shank moment of inertia about the tibia axis
$I_{zz}^{(3)}$ Foot moment of inertia about the tibia axis
$I_{zz}^{(4)}$ Boot moment of inertia about the tibia axis
$I_{zz}$ Leg moment of inertia about the tibia axis
$K_H$ Hip stiffness in medial-lateral rotation
$C_H$ Hip equivalent viscous damping in medial-lateral rotation $\theta$ Leg medial-lateral rotation
$\dot{\theta}$ First time derivative of $\theta$, $(d\theta)/(dt)$
$\theta_c$ Critical leg medial-lateral rotation, release criterion
$M_{z\,crit}$ Quasi-static tibia fracture strength in torsion
$M_z(t)$ Measured torsion moment
$\ddot{\theta}$ Second time derivative of $\theta$, $(d^2\theta/dt)2$
$M_{zs}$ Dynamic tibia moment in torsion
$I_{yy}^{(3)}$ Foot moment of inertia about the ankle flexion axis
$I_{yy}^{(4)}$ Boot moment of inertia about the ankle flexion axis
$I_{yy}$ Boot-foot moment of inertia about the ankle flexion axis
$K_{AB}$ Stiffness of the ankle-boot system in flexion
$C_{AB}$ Equivalent viscous damping of the ankle-boot system in flexion
$\phi$ Rotation of the boot-foot in flexion
$\dot{\phi}$ First time derivative of $\phi$, $(d\phi/dt)$
$\ddot{\phi}$ Second time derivative of $\phi$, $(d^2\phi/dt)2$
$\phi_c$ Critical rotation of the boot-foot in flexion, release criterion
$M_y(t)$ Measured flexion moment
$M_y$ crit Quasi-static tibia fracture strength in bending
$M_{ys}$ Dynamic tibia moment in bending
N Force, in Newtons
N-m Moment in Newton-meters A moment for devising a release decision technique may consist of the four following steps:

(a) Selection of specific injuries for prevention.
(b) Identification of injury mechanisms.
(c) Development of a biomechanical model which permits accurate assessment of injury proximity.
(d) Quantification of model parameters.

Commercial mechanical bindings have been, and commonly still are, designed and adjusted to prevent tibia fractures, both spiral and boot-top types. The first biomechanical model addresses these two types of tibia injuries as well. Based on tibia fracture research which is not set forth herein, it appears that a lower boundary failure criterion is simply the quasi-static failure load. The upper boundary failure criterion includes viscoelastic strengthening and any muscle support. To err conservatively, the failure measure used here is the quasi-static fracture strength.

First approximation dynamic system models for deriving release criteria to protect against tibia fracture are shown in FIG. 1, based on a number of assumptions including the following:

(a) Joint stiffness is linear, constant, and uncoupled.
(b) Joint damping is viscous and constant.
(c) Model response in medial-lateral rotation and flexion may be calculated independently.
(d) Inertias are constant.
(e) The ankle and knee joints are rigid in medial-lateral rotation.
(f) Bones are rigid.

Under these assumptions, the medial-lateral rotation model inertia $I_{zz}$ (see FIG. 1A) becomes $$I_{zz} = I_{zz}^{(1)} + I_{zz}^{(2)} + I_{zz}^{(3)} + I_{zz}^{(4)} \tag{1-1}$$

where the superscripts (1), (2), (3), and (4) denote the moments of inertia of the thigh, shank, foot, and boot, respectively, about the tibial axis. The stiffness $K_H$ and damping $C_H$ are properties solely of the hip joint. The inertia $I_{yy}$ in the flexion model is $$I_{yy} = I_{yy}^{(3)} + I_{yy}^{(4)} \tag{1-2}$$

where the superscripts (3) and (4) denote moments of inertia of the foot and boot, respectively, about the ankle joint flexion axis. Stuffness $K_{AB}$ and damping $C_{AB}$ are combined properties of the ankle-boot system.

To satisfy the lower boundary failure criterion, the binding should release when the model dynamic shank loading equals the quasi-static tibia fracture load. To compute the dynamic shank loading in medial-lateral rotation, the equation of motion is $$(I_{zz}^{(1)} + I_{zz}^{(2)} + I_{zz}^{(3)} + I_{zz}^{(4)})\,\ddot{\theta} + C_H\dot{\theta} + K_H\theta = M_z(t) \tag{1-3}$$

Assuming that $$|\,[I_{zz}^{(1)} + I_{zz}^{(2)}]\,\ddot{\theta}\,| << |\,K_H\theta\,| \tag{1-4}$$

and that $$|\,C_H\dot{\theta}\,|_{max} << |\,K_H\theta\,|_{max}, \tag{1-5}$$

then the loading $M_{zs}$ carried by the shank is given approximately by $$M_{zs} \approx K_H\theta. \tag{1-6}$$

The failure criterion demands that $$M_{zs} \leqq M_{z\,crit} \tag{1-7}$$

where $M_{z\,crit}$ is the quasi-static tibia fracture strength in torsion. Accordingly, the medial-lateral model response, $$\theta_c = \frac{M_{z\,crit}}{K_H},$$

$\theta_c$ is the release criterion for indicating injury proximity.

Similarly, the equation of motion in flexion (see FIG. 1B) is $$(I_{yy}^{(3)} + I_{yy}^{(4)})\,\ddot{\phi} + C_{AB}\dot{\phi} + K_{AB}\phi = M_y(t) \tag{1-8}$$

Neglecting the contribution of the damping term, the shank loading $M_{ys}$ becomes $$M_{ys} \approx K_{AB}\theta. \tag{1-9}$$

Since the failure criterion in flexion requires that $$M_{ys} \leqq M_{y\,crit} \tag{1-10}$$

where $M_{y\,crit}$ is the quasi-static tibia fracture strength in bending, the model response $\phi_c = M_{y\,crit}\,K_{AB}$ is the release criterion similarly indicating injury proximity as in the medial-lateral analysis of the model.

The release variables $\theta$ and $\phi$ of the above equations, particularly equation 1-6 for medial-lateral model response and equation 1-9 for flexion response, may be computed using generally conventional computer means with measured stress data obtained from the binding dynamometer as the biomechanical model input. The manner in which such data is obtained from the binding is described in greater detail below wherein different sets of strain gages are employed for measuring actual stresses relating to medial-lateral rotation and for flexion.

2. FIRST ANALOG CONTROL CIRCUIT

Typical analog computer means are illustrated in FIG. 2 for driving the biomechanical model equations with the loads obtained from the strain gage means and computing the biomechanical model-derived release variable established by the equations set forth above, as indicated by appropriate symbols in FIG. 2. Referring now to FIG. 2, a control circuit generally indicated at 22 comprises a conventional power source component 24 including batteries 26 for generating full range voltage $\rightleftarrows V_B$ and $-V_B$ for application where indicated throughout the remainder of the control circuit. In addition, a first regulator section 28 produces stepped-down voltages $+V_S$ and $-V_S$ which are also applied throughout the control circuit 22 as indicated. Another regulator section 30 generates further reduced voltage levels for direct application to both a flexion moment Wheatstone bridge assembly 34 and a torsional Wheatstone bridge assembly 32. An output signal from each of the Wheatstone bridge assemblies 32 and 34 is amplified by a signal conditioning amplifier 36 or 38 and applied to analog computer means 40 and 42.

The torsional analog computer means 40 is preprogrammed with model data including equation (1-6) while the flexion analog computer means 42 is also preprogrammed with data from the biomechanical model of FIGS. 1A and 1B including equation (1-9). Accordingly, the torsional analog computer means 40 operates to generate a release signal in an output line 44 when the stresses measured by one of the Wheatstone bridge assemblies of strain gages causes the release variable to exceed the release criterion established by the biomechanical model of FIG. 1A. Similarly, the flexion analog computer means 42 serves to generate a release signal in an output line 46 when the flexion moment $M_y(t)$ measured by the strain gages in the Wheatstone bridge assembly 34 causes the release variable to exceed the release criterion derived from the biomechanical model of FIG. 1B and the related equations.

The output line 44 from the torsional analog computer means 40 feeds two comparators 48 and 50, one of which is adapted to switch to a high mode when the absolute output value of the computer means 40 exceeds a preset voltage level corresponding to the release criterion referred to above. This of course corresponds with the output signal discussed immediately above. The output line 46 also feeds two separate comparators 52 and 54 which function similarly as the comparators 48 and 50 when the absolute output value for the flexion computer means 42 exceeds a predetermined voltage level corresponding to the release criterion for flexion. The analog computer circuits 40 and 42 are adjusted to produce equal release output voltages in the output lines 44 and 46. The four comparators 48–54 are preferably contained in a single integrated circuit 56 which may be programmed separately from the computer means 40 and 42 if desired. The gate of a silicon controlled rectifier or SCR 58 is connected to the outputs of all four comparators. Accordingly, when any of the comparators switches high, the SCR conducts to generate a release signal in a line 60. As illustrated in FIG. 2, the line 60 is interconnected with a solenoid 62 which serves as a preferred means for initiating release within a ski binding as will be described in greater detail below.

The first biomechanical model and the associated controls of FIG. 2 illustrate the possibility of initiating binding release in response to more than one mode of stress. As was indicated above, the first biomechanical model of FIGS. 1A and 1B was responsive to both flexion and torsional modes of stress. The association of the biomechanical model of FIGS. 1A and 1B with the control circuit of FIG. 2 illustrates the application of data from the model including equations developed in connection therewith to computer means within the control circuit for generating a release signal when the release variable exceeds the release criterion.

3. SECOND BIOMECHANICAL MODEL

A second biomechanical model is also adapted for specifically computing tibial loading. As in the first biomechanical model of FIGS. 1A and 1B, the second biomechanical model may also be adapted or expanded to be responsive to stresses in other parts of the model, for example in the ankle and knee in particular. However, even other injury modes could be separately emphasized in the model for initiating a release signal in suitable computer means for preventing another selected type of injury.

In any event, the second biomechanical model is specifically directed only toward torsional stress in the tibia rather than both flexion stress and torsional stress as with the first biomechanical model. However, the second biomechanical model includes a first variation indicated at 110 in FIG. 3A and a second variation indicated at 110' in FIG. 3B for respectively assessing tibial loading in two different type of situations, namely, during normal cruising skiing when the skier is moving in a generally stable configuration and during falls when the skier tends to be unstable and to have his weight concentrated on a single ski. Further in connection with the second biomechanical model of FIGS. 3A and 3B, a more detailed model of one of the lower skier extremities or legs is represented in FIGS. 4A and 4B. Referring initially to FIG. 4A, the skier's leg is represented with a single moveable joint at the hip, the knee and ankle being fixed or rigid, the other components of the leg and loading components applied thereto being self-apparent in connection with the nomenclature for the second biomechanical model as set forth below. Referring also to FIG. 4B, the leg is merely shown in a free body diagram of inertias in order to better represent the basis for the following equations developed in connection with the second biomechanical model.

Initially, the nomenclature of terms employed in connection with the equations developed for the second biomechanical model of FIGS. 3A and 3B are set forth in the following Table.

Nomenclature for Second Biomechanical Model $I_{zz}^{(0)}$ Torso moment of inertia
$I_{zz}^{(1)}$ Thigh moment of inertia about the tibia axis
$I_{zz}^{(2)}$ Shank moment of inertia about the tibia axis
$I_{zz}^{(3)}$ Foot moment of inertia about the tibia axis
$I_{zz}^{(4)}$ Boot moment of inertia about the tibia axis
$I_{zz}$ Leg moment of inertia about the tibia axis
$I_{zz}^{(s)}$ Ski moment of inertia about the tibia axis
$K_H$ Hip stiffness in medial-lateral rotation
$C_H$ Hip equivalent viscous damping in medial-lateral rotation
$M_{z\,crit}$ Quasi-static tibia fracture strength in torsion
$M_{zs/2}$ Dynamic tibia moment in torsion
$K_K$ Knee stiffness in medial-lateral rotation $K_A$ Ankle stiffness in medial-lateral rotation
$K_D$ Dynamometer stiffness in torsion
$\theta_1$ Absolute ski medial-lateral rotation
$\dot{\theta}_1$ First time derivative of $\theta_1$, $d\theta_{1/dt}$
$\ddot{\theta}_1$ Second time derivative of $\theta_1$, $d^2\theta_{1/dt}2$
$\theta_2$ Absolute leg medial-lateral rotation
$\dot{\theta}_2$ First time derivative of $\theta_2$, $d\theta_{2/dt}$
$\ddot{\theta}_2$ Second time derivative of $\theta_2$, $d^2\theta_{2/dt}2$
$\theta_3$ Absolute torso medial-lateral rotation
$\dot{\theta}_3$ First time derivative of $\theta_3$, $d\theta_{3/dt}$
$\ddot{\theta}_3$ Second time derivative of $\theta_3$, $d^2\theta_{3/dt}2$
T(t) Torque about tibia axis at the ski-snow interface
$M_z(t)$ Measured dynamometer torque The equations corresponding to the second biomechanical model of FIGS. 3A and 3B were developed in a generally similar manner as the equations relating to the biomechanical model of FIGS. 1A and 1B. However, further research has indicated that the failure analysis in torsion and bending may be treated independently. Accordingly, unlike the first biomechanical model, the equations for the second biomechanical model deal only with torsion stress. However, it will be immediately apparent that bending stress may also be taken into account for the second model under generally similar parameters as set forth below for torsion stress. In the second biomechanical model, the lower boundary of acceptable applied loads is the quasi-static fracture level as with the first biomechanical model. Following the conservative design approach, the failure measure used herein is the quasi-static fracture strength.

It is also important to formulate the second biomechanical model for accurate calculation of impending injury. Careful consideration of the skiing process leads to the observation that different biomechanical models are appropriate for controlled skiing and twisting type falls. To illustrate this point, consider FIGS. 3A and 3B which depict degenerate three degree-of-freedom models for the skier-ski system. The three inertias in each model are the torso inertia $I_{zz}^{(0)}$ *and the leg inertias* $I_{zz}$. The stiffness $K_H$ and dissipative element $C_H$ are properties of the hip joint. The principal difference between the two models is that during controlled skiing (FIG. 3A), the skier's torso is spatially fixed about the z axis, whereas during falls, for example (FIG. 3B), the ski is spatially fixed about the z axis. Even though the majority of the skier's weight is then on one ski, the spatial fixation in controlled skiing occurs because the unweighted ski is used for balance purposes. Accordingly, torsional shock loads measured between the boot and ski tend to excite the leg system exclusive of the torso. During twisting type falls, on the other hand, all the skier's weight is initially on one ski and the torso rotates relative to the fixed ski. In falls, it is the torso motion relative to the ski that loads the leg system.

Different equations describe the motion of each system in FIGS. 3A and 3B. Assuming that a dynamometer with stiffness $K_D$ measures the torsion loading between boot and ski, then the equations of motion for the ski-leg system in FIG. 1A become $$I_{zz}^{(s)}\ddot{\theta}_1+K_D(\theta_1-\theta_2)=T(t) \tag{2-1}$$

$$I_{zz}\ddot{\theta}_2+C_H\theta_2+K_H\theta_2=K_D(\theta_1-\theta_2) \tag{2-2}$$

where $I_{zz}$ is the ski moment of inertial about the tibia axis, T(t) is the torque between the snow and ski, and $\theta_1$ and $\theta_2$ are absolute rotations of the ski and leg, respectively. Neglecting the contribution of the unweighted leg in FIG. 3B, the equations of motion for the fixed ski system are $$I_{zz}^{(0)}\ddot{\theta}_3=C_H(\dot{\theta}_2-\dot{\theta}_3)+K_H(\theta_2-\theta_3) \tag{2-3}$$

$$I_{zz}\ddot{\theta}_2+C_H(\dot{\theta}_2-\dot{\theta}_3)+K_H(\theta_2-\theta_3)=-K_D\theta_2 \tag{2-4}$$

where $\theta_3$ is the absolute torso rotation. Because the ski is fixed and the dynamometer is stiff, the leg rotation $\theta_2$ will be quite small so that $\theta_2$, $\dot{\theta}_2$ and $\ddot{\theta}_2$ all approach zero. Equations (2-3) and (2-4) reduce to $$I_{zz}^{(0)}\ddot{\theta}_3+C_H\dot{\theta}_3+K_H\theta_3=-K_D\theta_2. \tag{2-5}$$

The loading carried by the tibia depends on which biomechanical model is operative. During falls, the tibia loading $M_{zs/2}$ is indicated directly by $$M_{zs/2}=M_z(t) \tag{2-6}$$

where $M_z(t)$ is the measured dynamometer load. During stable skiing, however, the tibia loading has a more complex relationship to the dynamometer load. The leg moment of inertia $I_{zz}$ is given by $$I_{zz}=I_{zz}^{(1)}+I_{zz}^{(2)}+I_{zz}^{(3)}+I_{zz}^{(4)} \tag{2-7}$$

where the superscripts (1), (2), (3), and (4) denote the moments of inertia of the thigh, shank, foot, and ski boot, respectively. From FIGS. 4A and 4B, the dynamic tibia loading $M_{zs/2}$ at the center of the shank is given by either $$M_{zs/2} = M_z(t) - [.5\, I_{zz}^{(2)} + I_{zz}^{(3)} + I_{zz}^{(4)}]\,\ddot{\theta}_2 \tag{2-8}$$

or $$M_{zs/2} = [.5\, I_{zz}^{(2)} + I_{zz}^{(1)}]\,\ddot{\theta}_2 + C_H\dot{\theta}_2 + K_H\theta_2. \tag{2-9}$$

From Equation (2-8), it is apparent that only when $$|\,[.5\, I_{zz}^{(2)} + I_{zz}^{(3)} + I_{zz}^{(4)}]\,\ddot{\theta}_2\,| << M_z(t) \tag{2-10}$$

does the dynamometer load accurately reflect the tibia load. This result is expected because Equation (2-10) is essentially the criterion for quasi-static loading. In controlled skiing, Equation (2-10) is not generally valid and Equation (2-8) or (2-9) must serve for injury proximity calculation if the retention requirement is to be satisfied.

The use of two different equations for tibia loading depending on the skiing situation is potentially enigmatic for the binding design problem. If the dynamometer load is the only measured variable, then the binding cannot differentiate between the loads of falling and the loads of controlled skiing. This problem may be reconciled only if the loads of falling satisfy the condition of Equation (2-10). Previous work has shown that the loads of falling do, in fact, satisfy Equation (2-10). Accordingly, the loads of falling are quasi-static and Equation (2-8) or (2-9) accurately reflects model tibia loading in both controlled skiing and falls.

In pure medial-lateral or torsion rotation, the most obvious discretized dynamic system model for the lower extremity consists of three degrees-of-freedom with the bootfoot, shank, and thigh as the three inertias. To facilitate designing and building of a controller which embodies the injury prevention technique, it is desirable to reduce the model complexity. Model complexity is reduced by assuming the second model to be a single degree-of-freedeom model within the ankle and knee joints assumed rigid, the ankle joint being the softer of the two. However, modern plastic ski boots offer significant support to the ankle in medial-lateral rotation and the rigid assumption is reasonable. Under these assumptions, the model reduces to that shown in FIGS. 4A and 4B. Accordingly, either Equation (2-8) or (2-9) may be used to compute the release variables $M_{zs/2}$. $M_{zs/2}=M_{z\,crit}$ is the release criterion.

The data from the second biomechanical model of FIGS. 3A, 3B, and 4A, 4B, as well as in the equations set forth above may be applied to computer means of a control circuit for a binding release mechanism in generally the same manner described above in connection with the first biomechanical model. Specifically, either Equation (2-8) or (2-9) may be applied to the computer component of the control circuit. In this regard, it may be seen that Equation (2-8) requires solution for leg angular acceleration $\ddot{\theta}_2$ which is then subtracted from the measured moment $M_z(t)$. On the other hand, Equation (2-9) requires computation of leg angular acceleration $\ddot{\theta}_2$, angular velocity of the leg $\dot{\theta}_2$, and leg medial-lateral rotation, $\theta_2$. Accordingly, it is believed that Equation (2-8) offers the simpler approach for programming of the computer component in the control circuit.

Figure 5:
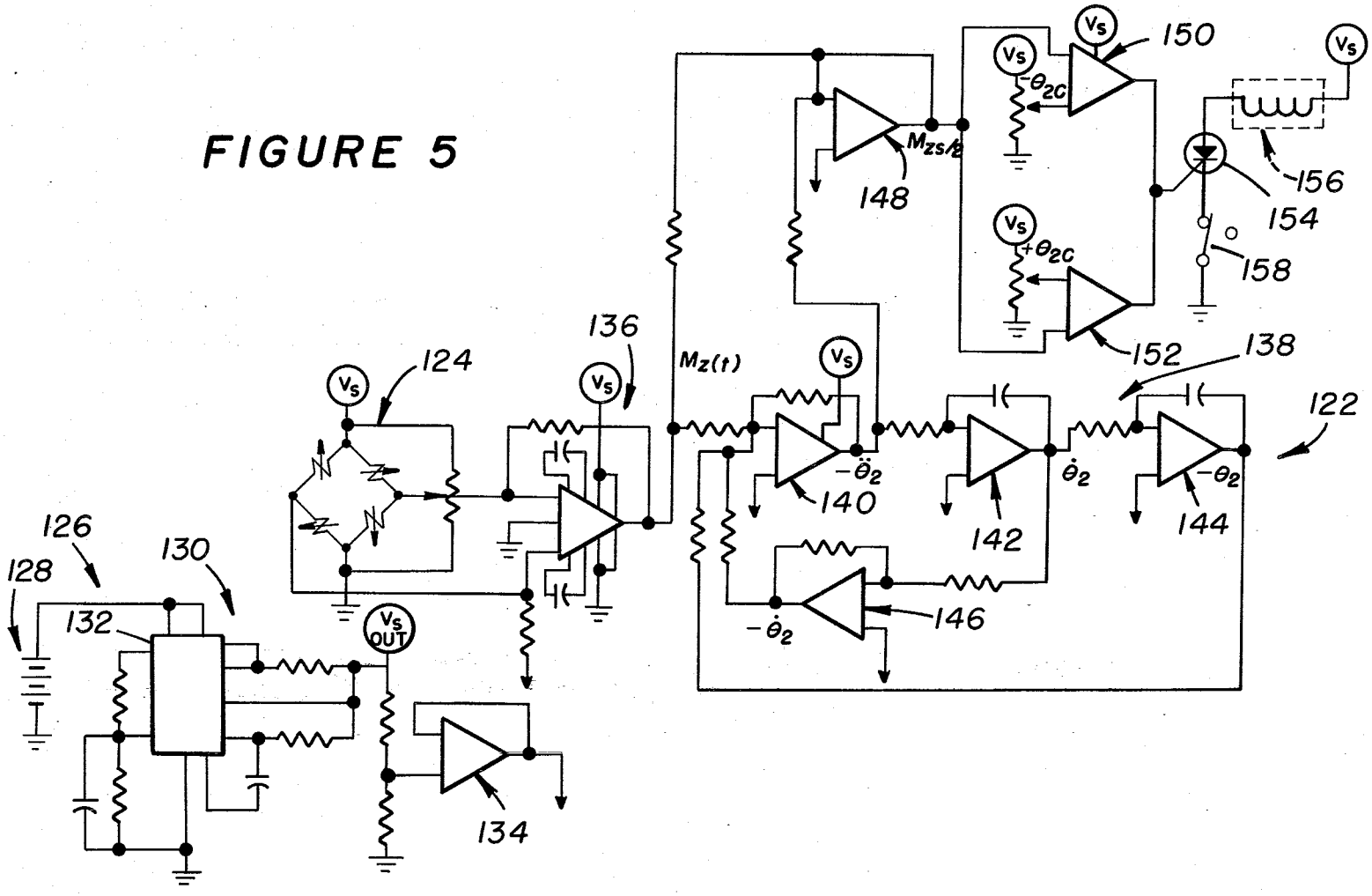
FIG. 5 is a schematic representation of another control circuit adapted for programming by biomechanical model equations such as for the model illustrated in FIGS. 3A and 3B in order to initiate a release actuating signal for a ski binding according to the present invention.
Figure 6:
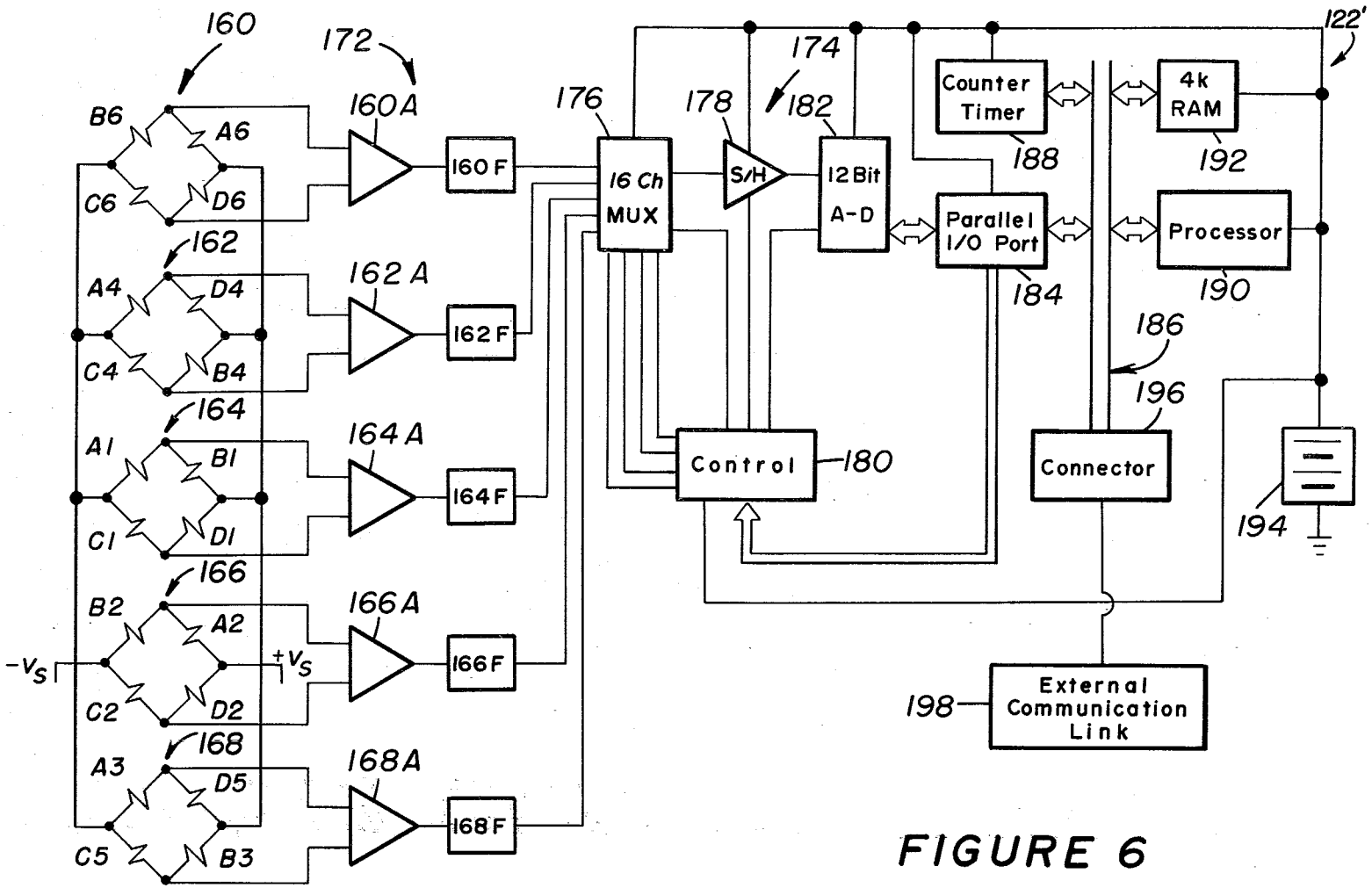
FIG. 6 is a similar schematic representation of yet another control circuit including digital components rather than analog components as used in the circuits of FIGS. 2 and 5.

Two effective control circuits for use with the second biomechanical model of FIG. 3 are illustrated respectively in FIGS. 5 and 6. The control circuit 122 of FIG. 5 may be seen as comprising an analog computer generally similar to that of FIG. 2. However, internal components of a computer portion of the control circuit 122 as well as other portions of the circuit have been modified relative to the control circuit of FIG. 2 in order to better adapt it for operation with data from the second biomechanical model. At the same time, another control circuit is indicated at 122' and includes a microcomputer adapted for operation in digital form for solving the same differential equations using numerical integration techniques. Advantages of the microcomputer in the control circuit 122 of FIG. 6 compared to analog type computer as illustrated in FIGS. 5 and 2 are described in greater detail below.

4. SECOND ANALOG CONTROL CIRCUIT

In addition, it may be seen that the control circuit 122 is adapted to receive actual stress data from a similar arrangement of stress gages formed into a Wheatstone bridge assembly 124 which is the same as the Wheatstone assembly 32 of FIG. 2. In this connection, it is again noted that the control circuit 122 is adapted for monitoring only torsional stress which is of course also the function of the Wheatstone bridge assembly 32 in FIG. 2. It will also be discussed in greater detail below that the actual stress data input for the control circuit 122 of FIG. 6 is applied from a different arrangement of strain gages which will be described below in connection with yet another embodiment of a ski binding constructed in accordance with the present invention.

Returning again to FIG. 5, it includes a simplified circuit 126 adapted for powering the entire control system 122 from a single battery 128. Unregulated voltage output at a nominal ten volts supplied from the battery 128 is applied to a single regulator section 130 comprising a standard linear integrated circuit device 132 for producing a regulated voltage output of approximately 5 Volts as indicated at $V_S$ which is applied to various portions of the control circuit 122 as indicated throughout FIG. 5. In order to enable operation of the complete control circuit 122 from the single battery 128, a circuit reference voltage of 2 Volts is generated by an operational amplifier 134. The power circuit 126 is similarly connected with the Wheatstone bridge assembly 124 in order to provide excitation similarly as with the Wheatstone bridge assemblies 32 and 34 of FIG. 2.

As with the embodiment of FIG. 2, the output from the Wheatstone bridge assembly 124 is applied to a single signal conditioning amplifier 136 which conforms to the signal conditioning amplifier 36 of FIG. 2. The output from the signal conditioning amplifier 136 is applied to analog computer means 138 comprising four operational amplifiers 140, 142, 144 and 146 arranged within a single quad amplifier device and a fifth operational amplifier 148 formed as a second device within the embodiment of FIG. 5. However, the specific arrangement of the operational amplifiers is not a feature of the present invention. In fact, the computer components for both the control circuits of FIGS. 2 and 5 are merely presented as examples of means for processing data from biomechanical models such as those illustrated in FIGS. 1A–1B and FIGS. 3A–3B. It will be apparent that a number of different computer components could be employed for achieving this purpose.

Returning again to FIG. 5, each of the operational amplifiers 140–148 includes programmable bias means for controlling its respective supply current similarly as in the embodiment of FIG. 2. Within the arrangement of the analog computer means 138 for the control circuit 122, low input offset voltage and low input bias current are not critical specifications for assuring integrating accuracy in the computer means 138. Integrator voltages are fed back and subtracted for respective operational amplifiers in order to achieve self-equilibration within the computer means and within the control circuit 122. Initial offset developed by the strain gages to be discussed below is removed with the balance potentiometer configuration for the Wheatstone bridge assembly 124. However, it is to be noted that low input offset voltage drift and input bias current drift are important to maintain circuit stability under varying temperatures. The operational amplifiers 140–148 are quite stable in this regard since their input bias currents are temperature-compensated.

Finally, within the computer component 138 of the control circuit 122, it may be seen that the first four operational amplifiers 140–146 of the differential equation portion of Equation (2–2) function much as the three operational amplifiers function in the computer means 40 of FIG. 2. The fifth operational amplifier 148 performs the function of subtracting the acceleration $\ddot{\theta}_2$ value obtained by the four operational amplifiers 140–146 from the measured applied load $M_z(t)$ in order to solve Equation (2–8). In this connection, it may be seen that the output from the signal conditioning amplifier 136 is also applied directly to the fifth operational amplifier 148.

The output from the fifth operational amplifier 148 is the release variable which is compared to the release criterion established by the data from the second biomechanical model. The signal from the fifth operational amplifier 148 including the data is applied to a pair of comparators 150 and 152 which function in the same manner as the comparators 48 and 50 of FIG. 2 in order to initiate a release signal by actuating a silicon controlled rectifier or SCR 154. Within the embodiment of FIG. 5, actuation of the SCR 154 fires a solenoid 156 which for example may be coupled with release means within a binding. Here again, it is to be noted that the solenoid 156 is merely one example of release means which may be actuated within a binding by the control circuit 122. The function of the solenoid 156 for initiating release is also described in greater detail below in connection with one embodiment of a binding according to the present invention. In order to reset the circuit, a switch 158 is provided in connection with the SCR 154 and may be manually operated to momentarily break a current for the SCR 154 in order to deactuate the solenoid 156.

5. DIGITAL CONTROL CIRCUIT

Referring now to FIG. 6, the control circuit 122' is illustrated in generally schematic form and described briefly below in order to indicate the possibility of using digital computer means for solving the equations relating to second biomechanical model of FIGS. 3A and 3B similarly as the control circuit 122 of FIG. 5. Before describing the basic components of the control circuit 122', which components in themselves are generally conventional, it is again noted that the actual stresses applied to the control circuit 122' are somewhat more complex and are obtained from strain gages arranged in a ski binding as will be described in greater detail below. In any event, five Wheatstone bridge assemblies 160, 162, 164, 166 and 168 are illustrated as including separate strain gage means for monitoring various load components. The specific arrangement of the various strain gages will also be described in greater detail below. In any event, the output from the respective Wheatstone bridge assemblies are processed by separate signal conditioning amplifiers 160A etc., and associated anti-aliasing or low-pass filters 160F, etc. The signal conditioning amplifiers and filters together with a sixth signal conditioning amplifier 170A and associated anti-aliasing or low pass filters 170F form a signal conditioning section 172, the combined output of which is applied to a digital data acquisition section 174 for converting analog data received from the Wheatstone bridges into digital form for use within the digital computer means referred to below.

The digital data acquisition section 174 includes a time division multiplexer sampling device 176 interconnected to a sample/hold amplifier 178 and to an analog-to-digital converter 182 for supplying the measured stress data in digital form. That information provided as an output from the analog digital converter 182 is applied to a parallel I/O input assembly 184 in order to apply the data to a computer bus 186 interconnected with a countertimer 188, a digital processor 190 and memory means 192. A power source 194 is generally indicated at 194 and is interconnected with the entire control circuit 122' through the digital processor 190.

The power source 194 may include a number of different batteries for supplying power to different portions of the control circuit in generally conventional fashion. The important feature in connection with the power source 194 of the present invention is its interconnection with the entire control circuit 122' and with the digital processor 190 to permit monitoring of all voltage levels by the digital processor 190. The control circuit 122' also includes external connector means 196 coupled with the computer bus 186 for a purpose to be described immediately below.

The control circuit 122' operates digitally to perform the same function described in greater detail above for the control circuit 122 of FIG. 5 and the control circuit 22 of FIG. 2. Accordingly, the control circuit 122' could also include actuating means responsive to the computer processor 190 for initiating a release signal to operate release means within an associated ski binding.

Numerous advantages are obtainable with use of the microcomputer control circuit 122' of FIG. 6. Initially, use of the microcomputer could enhance ski safety even in comparison with the analog control circuits of FIGS. 2 and 5. Release accuracy is improved in the control circuit 122' since the effects of offset voltage, etc., being nullified by auto-zeroing of the microcomputer signals or the dynamometer signals from the Wheatstone bridges 160–168 prior to actual solution of the differential equation for the second biomechanical model within the circuit. In addition, a microcomputer may also be employed to check functionality of various components in the circuit such as the power source, the dynamometer or strain gage signals themselves as well as the dynamometer channels in order to assure that the binding as well as the control circuit components are working properly. If not, the microcomputer could provide a signal as a warning to the skier which would also provide an important safety feature within the binding assembly. Yet another advantage possible from the use of a microcomputer is that the differential equations are solved in software. Accordingly, any refinement of the control algorithm employed within the processor 190 and/or the differential equations themselves could be easily implemented within the binding assembly without the need to resort to hardware changes simply by using external programming means (not shown) which could be coupled into the processor 190 through the connector 196.

Still another advantage for the microcomputer control circuit 122' is that the differential equations applied to the processor 190 would likely vary for different individuals depending upon the physiological characteristics, skiing ability, skiing conditions and the like. Here again, different parameters adapted for different individuals or conditions could be readily entered into the processor 190 again through the external connector means 196. Generally, analog computer, on the other hand, would require adjustment in some of its circuit components which would be a relatively complicated procedure. An external communication link for supplying such data to the connector 196 is generally indicated at 198 and could take a number of forms, the specific nature of which is not an essential feature of the present invention. For example, the communication link 198 could comprise a hand-held terminal (not shown) consisting of a keyboard, monitoring light emitting diodes to indicate conditions within the computer and erasable programmable read-only memory means containing program and/or instructions to the processor. However, the communication link 198 could take a number of different forms. For example, the hand-held terminal might also include connector means for a teletype or cathode ray terminal in order to permit application of data in that manner. In that event, the possible use of such external communication link 198 for making adjustments within the control circuit 122' is believed clearly apparent.

6. FIRST SKI BINDING EMBODIMENT

As was indicated above, the two biomechanical models and the associated control circuits described with reference to FIGS. 1–6 are subject to substantial modification with features of the two biomechanical models and three control circuits being interchangeable. Two embodiments of ski bindings particularly adapted for combination with the abovenoted control circuits are described below. A first embodiment of such a ski binding is illustrated in FIGS. 7 and 8 with an arrangement of strain gages being illustrated in FIG. 9. Because of the specific configuration of strain gages in FIG. 9, the first ski binding embodiment of FIGS. 7–9 is adapted for use with the control circuit of FIG. 2. However, it will be apparent from the preceding description and the following description of the two ski binding embodiments that the ski binding embodiment of FIGS. 7–9 could also be employed in combination with a control circuit of the type in either FIG. 5 or FIG. 6. Similarly, a second ski binding embodiment is illustrated in FIGS. 10 and 11 with an arrangement of strain gauges thereupon being illustrated by FIGS. 12 and 13. Here again, because of the specific configuration and number of strain gages, it will be apparent that the embodiment of FIGS. 10–13 is adapted for use with the control circuit of FIG. 6. However, again, it will be apparent that upon suitable modification as is made clearly apparent herein, the ski binding embodiment of FIGS. 10–13 could also be adapted for use with a control circuit of the type shown in FIG. 2 or in FIG. 5.

Referring now to FIGS. 7 and 8, a ski binding assembly 210 is illustrated for selectively and releasably securing a ski boot 212 to a ski such as that indicated at 214. The ski 214 is of a generally standard configuration while the boot 212 is also of conventional design capable of substantially rigidizing the skier's ankle in accordance with the assumption made in connection with the two biomechanical models described above.

The binding assembly 210 includes a binding platform 216 secured to the ski 214 and a mating mounting plate 218 secured to the bottom of the ski boot 212.

A releasable clamp unit for securing the mounting plate 218 in place upon the platform 216 is generally indicated at 220 and includes a pair of levers 222 and 224. The clamping ends 226 of each lever include recesses 228 for mating with similarly shaped projections 230 on the mounting plate 218. Thus, with the mounting plate arranged in abutting and aligned position upon the binding platform 216, the mounting plate and accordingly the boot 212 may be secured and placed thereupon by engagement of the clamping ends 226 with the projections 230.

The levers are operated through a force multiplication linkage 232 by a hydraulic 234 which is also illustrated in FIG. 8 and includes manually operated means 236 operable for causing a plunger 238 to act through the force multiplication linkage 232 for engaging the levers 222 and 224 with the mounting plate of the boot. The hydraulic 234 also includes release actuating means preferably in the form of the solenoid indicated at 62 (also seen FIG. 2). As indicated in FIG. 8, the solenoid 62 may be operated by a release initiating signal from the control circuit 22 which is also illustrated in FIG. 2.

These components of the ski binding assembly 210 are described below in greater detail. Initially, the levers 222 and 224 are commonly pivoted at 242 under a retainer element 241 and bearing plate 243. The ends of the levers opposite the clamping ends 226 are respectively and pivotably coupled at 244 and 246 with respective wedging levers 248 and 250 which are pivotably interconnected with each other and with the plunger 238 at 252. The combined length of the two wedging levers 248 and 250 is slightly greater than the distance between the pivot connections 244 and 246 when the levers are clamped upon the boot to prevent over-center movement of the wedging levers. Through this arrangement, as the plunger 238 is shifted rightwardly as viewed in FIG. 7, it acts upon the intermediate lever 208 which in turn acts upon the two wedging levers 248 and 250 in order to apply substantially multiplied force to the levers 222 and 224 in order to maintain them in rigid clamping engagement with the mounting plate 218 upon the ski boot 212. The purpose of the intermediate lever which pivots about its base is to reduce travel of plunger 238.

Referring now to FIG. 8, the hydraulic unit 234 includes a main chamber or cylinder 254 containing a piston 256 arranged for reciprocable movement therein, the plunger 238 penetrating one end wall of the chamber or cylinder 254 for connection with the piston 256. A reserve chamber or cylinder 258 similarly contains a reciprocable piston 260, a rod 262 for the piston 260 penetrating one end of the reserve chamber 258 for connection with the manually operated handle 236. The reserve chamber 258 is in communication with the main chamber 254 by means of a conduit 264 containing a one-way check valve 266 permitting pressurization of the main chamber by manipulation of the lever 236. The main chamber 254 is also in communication with the reserve chamber 258 by means of a second conduit 268 which is normally closed by the solenoid 240. However, as noted above, when the solenoid receives a release initiating signal from the control circuit 22, it opens in order to release fluid under pressure from the main chamber 254. Immediately thereupon, a spring load acting upon the plunger 238 immediately causes the plunger 238 and the piston 256 to retract which permits the levers 222 and 224 to completely disengage from the mounting plate 218 upon the ski boot.

Returning again to the manner of engagement between the boot 212 and the binding 210, both the mounting plate 218 and the platform 216 are especially configured so that horizontal movement or rotation of the boot is not entirely resisted by the levers 222 and 224. For this purpose, the platform 216 includes a plurality of hemispherical projections 270 preferably arranged at each corner of that platform 216. Mating hemispherical recesses 272 are formed upon the corners of the mounting plate 218 in order to receive the hemispherical projections 270. Because of the mating engagement of the hemispherical projections 270 within the recesses 272, horizontal movement and more specifically lateral rotation of the boot tends to produce torsional forces which are applied directly to the platform 216. In order to even more completely transfer all reaction forces of the boot 212 to the platform 216, the platform 216 is formed with projections 274 which are in alignment with the projections 230 on the mounting plate 218 and are adapted for similar engagement with the recesses 228 in the clamping levers 222 and 224. Accordingly, both rotational and bending reaction forces arising in the boot 212 relative to the ski 214 are transferred through the platform 216.

This arrangement described above for the platform 216 permits the mounting of strain gages for monitoring both torsional and bending moments upon a structural strain gage element between the platform 216 and the ski. The structural strain gage element which is thus arranged directly beneath the platform 216 is indicated at 275 in FIG. 9. Referring to FIG. 9, the structural strain gage element 275 is a simple cylinder adapted for engagement at its upper end with the platform 216 and at its lower end with a portion of the binding attached to the ski. A forwardly facing surface of the strain gage element or cylinder 275, facing toward the forward tip (not shown) of the ski 214, as indicated by the arrow X, provides a mounting surface for four strain gages. A reverse surface of the strain gage element or cylinder is represented by a reverse representation of the cylinder 275' which is rotated 180° from the position illustrated for the element or cylinder 275 in order to illustrate the mounting of four additional strain gages on the opposite surface of the cylinder.

The strain gages mounted upon the cylinder 275 include four strain gages G1, G2, G3 and G4 adapted for monitoring bending moments experienced by the structural strain gage cylinder 275. Accordingly, strain gages G1 and G2 are arranged in parallel and vertically extending configurations on the rear surface of the strain gage cylinder as illustrated at 275'. The other two bending strain gages G3 and G4 are similarly arranged on the opposite or forward surface of the strain gage cylinder 275. Similarly for torsion measurement, two strain gages G5 and G6 are arranged upon the rearward surface of the strain gage cylinder 275 in perpendicularly overlapping relation with each other, each of the strain gages being arranged at an angle of 45° from horizontal. The two remaining strain gages G7 and G8 are similarly disposed upon the forward surface of the strain gage cylinder 275.

Referring now also to the control circuit 22 of FIG. 2, the strain gages G1, G2, G3 and G4 are arranged as indicated within the Wheatstone bridge assembly 34 in order to supply suitable data regarding actual bending stresses to that portion of the control circuit 22 concerned with flexion. The other four strain gages G5, G6, G7 and G8 are similarly arranged within the other Wheatstone bridge assembly 32 which is concerned with the monitoring of torsional stresses as was also described above in connection with the control circuit 22. At the same time, a similar arrangement of the strain gages G5–G8 could also be employed to form the Wheatstone bridge assembly 124 within the control circuit 122 of FIG. 5 which, as was noted above, is concerned only with torsion moments and not with bending moments.

In order to briefly summarize the mode of operation for the binding assembly 210 in combination with the control circuit 22 of FIG. 2, the boot 212 is rigidly attached to the ski 214 by the clamping levers 222 and 224 as well as the other related components of the binding assembly 210. In that configuration, both torsional and bending stresses arising between the boot and the ski, representative of the first biomechanical model illustrated in FIGS. 1A and 1B, are monitored by the strain gages of FIG. 9 and supplied to the control circuit 22. Upon the release criterion being satisfied, the control circuit 22 functions as described above to generate an initiating signal to the solenoid 62 which appears in each of FIGS. 2, 7 and 8. Thereupon, the solenoid 62 acts through the hydraulic unit 234 to disengage the clamping levers 222 and 224 from the mounting plate on the ski boot 212. It may be seen that the hemispherical configuration for the projections 270 and recesses 272 serve to facilitate disengagement between the ski boot and the ski upon release in order to further prevent the possibility of injury to the skier. The skier may reattach the boot 212 to the ski by placing the mounting plate 218 in alignment with the binding platform 216 and manipulating the lever 236 in order to pressurize the main chamber 254, thereby causing the plunger 238 to move the clamping levers 222 and 224 into rigid clamping engagement with the mounting plate 218 on the boot 212.

7. SECOND SKI BINDING EMBODIMENT

Another embodiment of a ski binding assembly constructed in accordance with the present invention is generally indicated at 310 in FIG. 10 and operates in generally the same manner as the ski binding assembly 210 of FIG. 7. However, the dynamometer or strain gage component of FIG. 7 embodiment as well as its binding components including the clamping assembly and hydraulic unit are replaced by a combined dynamometer/releasable binding component 312 which mounts directly upon the ski 314 for binding engagement with the ski boot 316. The binding assembly 310 also includes a release actuating means preferably in the form of a pyrotechnic squib 318 which is responsive to a release actuating signal from the control circuit 122' of FIG. 6.

The combined dynamometer/releasable binding component 312 includes a structural dynamometer or strain gage element 320 which has slotted portions 322 and 324 arranged at opposite ends thereof in order to form four half-strain rings upon which strain gages are to be mounted in accordance with the following description. The dynamometer element 320 may be attached to the ski for example by screws 326 which secure the bottom half of slotted portions 322 and 324 to the ski.

The integral releasable binding portion of the combined dynamometer/releasable binding component 312 includes a pair of annular rings 328 and 330 both arranged horizontally above the ski 314. The ring 328 is integrally formed with the slotted dynamometer portions 322 and 324 and includes a plurality of radially extending, shaped ports 332 for respectively capturing ball bearings 334. The other ring 330 is attached to the boot 316, preferably within a recess 336 formed in the sole of the boot, the ring 330 being of annular configuration with a tapered central cavity 338 adapted for nesting arrangement of the rings 328 and 330 as may be best seen in FIG. 10. The tapered central cavity 338 also includes spherical depressions 340 adapted for detent engagement with the ball bearings 334 in a manner described in greater detail below. A locking piston 342 is arranged within the ring 328, the ski binding assembly 310 also including a spring means 344 arranged for interaction between the boot 316 and the locking piston 342 in order to urge the locking piston downwardly whereupon the ball bearings 334 are forced outwardly into detent engagement with the spherical depressions 340. The various components in the configuration illustrated in FIG. 10, the boot 316 is then secured rigidly to the ski 314. At the same time, all reaction forces are transmitted between the boot 316 and the ski 314 through the structural dynamometer or strain gage element 320. Accordingly, strain gages may be disposed directly upon the structural dynamometer element 320 in order to monitor those reaction forces.

Referring also to FIGS. 12 and 13, four sets of strain gages are arranged at the four corners of the structural dynamometer element as indicated by the letters A, B, C and D. At each of those locations, the slotted portions 322 and 324 of the structural dynamometer element 320 form a vertical wall 346 and an adjacent wall portion arranged at an angle of 45° to the adjacent wall portion 346. Each of the wall portions arranged in a 45° inclination are indicated at 348. A combination of five strain gages is arranged in each of the locations A–D in order to permit a compensated arrangement of the strain gages within a plurality of Wheatstone bridges such as those indicated at 160–168 in FIG. 6.

The arrangement of the strain gages in the locations A and C is illustrated in FIG. 12 while the arrangement of strain gages at the locations B and D is illustrated in FIG. 13. Furthermore, as noted above, each of the slotted portions 322 and 324 includes a laterally extending slot 350 with a circular opening 352 adjacent each of the strain gage locations A–D. In the strain gage arrangement for each of the locations A and B, strain gages A3 and B3 are arranged upon the cylindrical surface of the opening 352 in the alignment indicated respectively in FIGS. 12 and 13. The strain gage combinations for each of the locations C and D includes an externally mounted strain gage C5 or D5 respectively. This arrangement of the strain gages A3, B3 and C5, D5 permits a more balanced or compensated arrangement for the Wheatstone assemblies of FIG. 6 as will be described in greater detail below. The mounting of the numerically identified strain gages in each assembly are illustrated in FIGS. 12 and 13. For the strain gage assemblies A and B, strain gages A4, A6 and B4, B6 are mounted upon the vertical wall portion 346. In the strain gage assemblies C and D, the strain gages C4, C5, C6 and D4, D5, D6 are all similarly arranged upon one of the vertical wall portions 346. In all of the strain gage assemblies A, B, C and D, the first and second strain gages are mounted upon the inclined wall portions 348. Accordingly, it may be seen that all of the strain gages in the four assemblies are arranged perpendicular to the longitudinal axis of the ski. This configuration for the strain gages results in a compact and rugged dynamometer which is sensitive to all load components between the ski and boot with the exception of the force component along the longitudinal axis of the ski. It has been determined experimentally that loading in this direction is not of particular significance in predicting release for avoiding ski injuries.

Referring also to FIG. 6, the twenty strain gages at locations A, B, C and D are arranged in the five Wheatstone bridges 160–168 in order to supply compensated data to the control circuit 122' in the manner described above. Upon a release criterion being satisfied, the control circuit 122' functions in the manner described above to generate a release initiating signal in an output line 354 which is connected with the pyrotechnic squib 318. Detonation of the squib 318 immediately forces the locking piston 342 upwardly against the spring 344 allowing the ball bearings 334 to move radially inwardly and thereupon release the boot and outer annular ring 330 from the inner ring 328. Use of the two nested, annular rings 328 and 330 is of particular advantage within the binding assembly 310 because it permits movement of the boot in effectively any direction after release is accomplished. The tapered annular configuration for the central cavity 338 further contributes to facilitating release between the rings 328 and 330.

Thereafter, the skier at his option may reactivate the binding 310 by replacing the squib 318 and engaging the ring 330 on the boot with the ring 328 and at the same time urging the locking piston 342 downwardly into the locked configuration illustrated in FIG. 10. The openings or ports 332 which hold the ball bearings 334 are of course shaped in order to prevent escape of the ball bearings even when the boot is separated from the ski.

Also referring to FIGS. 10 and 11, the skier may selectively release the binding by rotating a lever 360 secured to a shaft 362 extending into the cavity 338 beneath the piston 342. The inner end of the shaft is formed with a cam surface 364 for shifting the piston 342 upwardly against the spring 344 to release the binding upon rotation of the shaft 362 by the lever 360.

In both the embodiments of FIGS. 7–9 and the embodiment of FIGS. 10–13, the thickness of the binding may be minimized between the ski boot and the ski as may be best seen in FIGS. 7 and 10. At the same time, it is again noted that the two ski binding embodiments may be adapted for use with any of the control circuits illustrated respectively in FIGS. 2, 5 and 6.

It is also noted again that numerous modifications and variations are believed apparent within the biomechanical models, the associated control circuits and the two ski binding embodiments. Accordingly, the scope of the present invention is defined only by the following appended claims.

What is claimed is:

1. In a ski binding for releasably securing a ski boot to a ski, a method for minimizing injuries in a lower extremity of a skier, said method comprising:

measuring a plurality of mechanical deflections induced in said ski binding from interaction between said skier and said ski;

developing a plurality of first electrical signals, each of said first signals being determined from a different one of said deflections;

developing a plurality of second electrical signals determined from a relationship between said first signals, said second signals defining a measurement of forces along first selected ones of longitudinal, lateral, and vertical axes of said ski and moments about second selected ones of said axes, said mechanical deflections occurring in response to said forces and said moments; and computing from said second signals an actual angle of deflection based on a preprogrammed relationship between said second signals, said actual angle of deflection being about a location of said lower extremity of the skier, said location being selected to prevent injury thereto, said computing step including comparing said actual angle of deflection with a predetermined critical angle of deflection to initiate a release of said ski binding in the event said actual angle exceeds said critical angle.

* * * * *